United States Patent [19]

Broadhurst

[11] Patent Number: 4,502,787

[45] Date of Patent: Mar. 5, 1985

[54] AGITATED HEAT EXCHANGER TO CHILL SOLVENT-OIL AND WAX SLURRY TO WAX FILTRATION TEMPERATURE

[75] Inventor: Thomas E. Broadhurst, Sarnia, Canada

[73] Assignee: Exxon Research & Engineering Co., Florham Park, N.J.

[21] Appl. No.: 558,175

[22] Filed: Dec. 5, 1983

Related U.S. Application Data

[62] Division of Ser. No. 245,712, Mar. 20, 1981, Pat. No. 4,441,987.

[51] Int. Cl.[3] ..... B01F 15/06

[52] U.S. Cl. ..... 366/149; 165/109 R; 366/293; 366/330; 366/331

[58] Field of Search ..... 366/144, 149, 279, 292, 366/293, 331, 325, 330, 300, 301; 208/33, 38; 165/94, 109 R; 34/61, 60

[56] References Cited

U.S. PATENT DOCUMENTS

| | | | |
|---|---|---|---|
| 646,555 | 4/1900 | McLennan | 366/330 |
| 676,165 | 6/1901 | Wacker . | |
| 1,081,516 | 12/1913 | Reinohl . | |
| 1,796,772 | 3/1931 | Torrance . | |
| 2,361,035 | 10/1944 | Klaassen . | |
| 2,361,503 | 10/1944 | Schutte et al. . | |
| 2,625,502 | 1/1953 | Backlund et al. . | |
| 2,628,077 | 2/1953 | Handwerk . | |
| 2,630,302 | 3/1953 | Jones . | |
| 2,725,338 | 11/1955 | Perry . | |
| 2,903,411 | 9/1959 | Shuman | 208/37 |
| 3,159,563 | 12/1964 | Anastasoff et al. | 208/30 |
| 3,393,144 | 7/1978 | Button et al. | 208/28 |
| 3,773,650 | 11/1973 | Hislop et al. | 208/33 |
| 3,775,288 | 11/1973 | Eagen et al. | 208/33 |
| 3,973,623 | 8/1976 | Geoffrey | 165/94 |
| 4,058,907 | 11/1977 | Lipp et al. | 34/61 |
| 4,115,244 | 9/1978 | Pitman et al. | 208/33 |
| 4,140,620 | 2/1979 | Paulett | 208/33 |

*Primary Examiner*—Timothy F. Simone

*Attorney, Agent, or Firm*—Joseph J. Allocca

[57] ABSTRACT

An improved process for dewaxing waxy hydrocarbon oils, wherein said waxy oil is introduced at a temperature above its cloud point into a direct chilling zone divided into a plurality of stages, passing said waxy oil from stage-to-stage of said chilling zone, introducing a cold dewaxing solvent into at least a portion of said stages, maintaining a high degree of agitation in at least a portion of the stages containing solvent and waxy oil, thereby effecting substantially instantaneous mixing thereof while cooling said solvent-waxy oil mixture, preferably at a rate of from about 1° to 8° F./min., as it progresses through said direct chilling zone to a temperature greater than the wax separation temperature, whereby a substantial portion of the wax is precipitated from said waxy oil under conditions of said high degree of agitation and forming a solvent-oil mixture containing precipitated wax (slurry I), withdrawing said slurry I from said direct chilling zone and cooling same to the wax separation temperature in an indirect chilling zone thereby precipitating a further portion of wax from said waxy oil and separating said precipitated wax from the wax-oil-solvent mixture in solid-liquid separation means, the improvement comprising using as the indirect chilling zone an indirect heat exchanger means operated at a high level of agitation. Expressed in terms of Impeller Reynolds Number the agitation is on the order of about 1,000 to 1,000,000.

Alternatively, the staged, agitated, direct chilling zone is totally replaced by the high agitation indirect heat exchanger means.

6 Claims, 1 Drawing Figure

AGITATED HEAT EXCHANGER

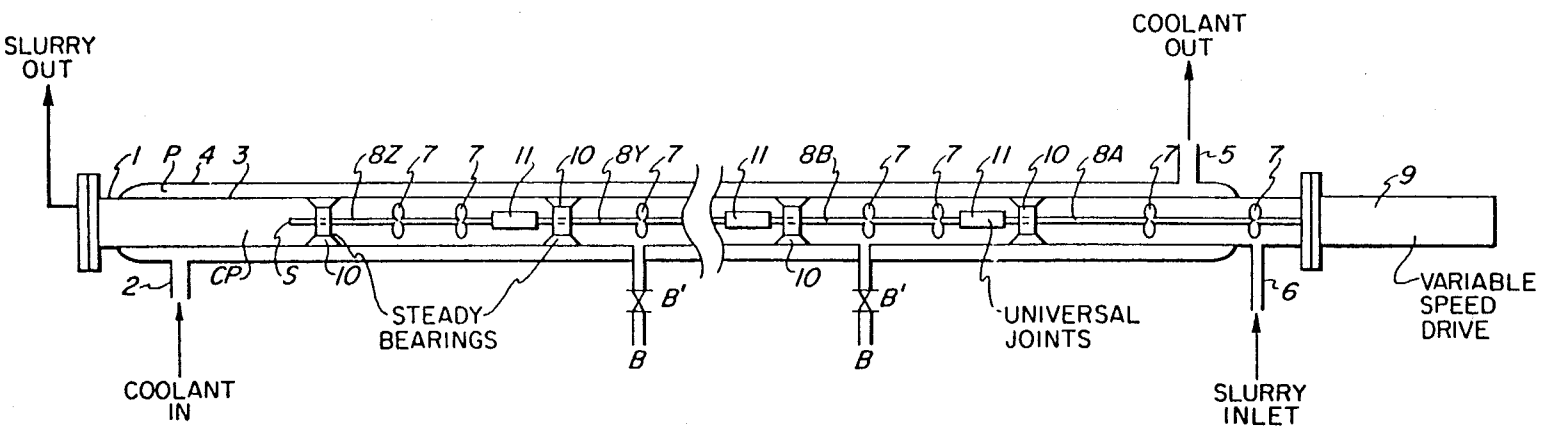
Figure I
AGITATED HEAT EXCHANGER

AGITATED HEAT EXCHANGER TO CHILL SOLVENT-OIL AND WAX SLURRY TO WAX FILTRATION TEMPERATURE

This application is a division of application Ser. No. 245,712 filed Mar. 20, 1981, now U.S. Pat. No. 4,441,987.

BRIEF DESCRIPTION OF THE INVENTION

This invention relates to an improved process for dewaxing hydrocarbon oils, particularly petroleum oils, most particularly lube oils wherein said waxy oil is introduced at a temperature above its cloud point into a direct chilling zone divided into a plurality of stages, passing said waxy oil from stage-to-stage of said chilling zone, introducing a cold dewaxing solvent into at least a portion of said stages, whereby a solvent-waxy oil mixture is formed, maintaining a high degree of agitation in at least a portion of the stages containing solvent and waxy oil, thereby effecting substantially instantaneous mixing of said solvent and said waxy oil while cooling said solvent-waxy oil mixture, preferably at a rate of from about 1° to 8° F./min., as it progresses through said direct chilling zone to a temperature greater than the temperature at which the wax is separated from the oil, i.e., the wax separation temperature, whereby a substantial portion of the wax is precipitated from said waxy oil under conditions of said high degree of agitation and forming a solvent-oil mixture containing precipitated waxy (slurry I), withdrawing said mixture containing precipitated wax from said direct chilling zone and cooling same to the wax separation temperature in an indirect chilling zone thereby precipitating a further portion of wax from said waxy oil and separating said precipitated wax from the wax-oil-solvent mixture in solid-liquid separation means, the improvement comprising using as the indirect chilling zone an indirect heat exchanger means operated at a high level of agitation. Expressed in terms of Impeller Reynolds Number the agitation is on the order of about 1,000 to 1,000,000 preferably 5,000 to 1,000,000 and most preferably 10,000 to 1,000,000.

Alternatively, the staged, agitated, direct chilling zone is totally replaced by the high agitation indirect heat exchanger means. Optionally, provision for multipoint solvent injection can be made, so that any combination of indirect and direct chilling of the waxy oil feed can take place simultaneously. In this way, the waxy oil feed is taken from a temperature above its cloud point directly to the wax separation temperature in a single or plurality of said indirect heat exchanger units.

By employing this high agitation, and using a combination of direct and indirect chilling so as to avoid sudden temperature changes in excess of 40° F., in the heat exchange chilling zone, increases in feed filter rate and improvements in dewaxed oil yield are realized.

BACKGROUND OF THE INVENTION

In the past, wax precipitation was conducted under conditions of low or no agitation. This procedure was followed since it was believed that precipitation under conditions of high agitation would result in the formation of fine wax particles which would clog the liquid-solid separators. The typical wax precipitation technique employed scraped surface chillers. In such a unit a waxy oil and a dewaxing solvent are premixed at a temperature sufficient to effect complete solution of the oil and wax. If necessary, the waxy oil is heated (either prior to or after additions of solvent) to insure complete solution of the wax contained therein.

The solution is then indirectly cooled at a uniformly slow cooling rate, e.g., 1° to 5° F./min., under conditions which avoid substantial agitation of the solution during precipitation of the wax. Because of fouling of the exchanger wall in the indirectly cooled heat exchangers due to wax deposition on the exchanger surface, scrapers are employed to remove the wax. However, because of the physical crushing of the wax crystals formed on the chiller wall by the action of the scrapers, nonuniform crystal growth occurs which results in slow filtration rates and large amounts of occluded oil in the wax.

The DILCHILL® (DILCHILL is a registered service mark of Exxon Research and Engineering Company) process was developed so as to overcome the inherent limitations and disadvantages of scraped surface chilling dewaxing. In the DILCHILL process, cooling is accomplished in a staged tower. The waxy oil is moved through the tower while cold solvent is injected along the tower directly into a plurality of the stages (either some or all of the stages have cold solvent injected into them). The cold solvent injection is accompanied by a high degree of agitation in at least a portion of the stages containing waxy oil and solvent so as to insure substantially instantaneous mixing of the cold solvent and waxy oil. Chilling is conducted to a temperature of between about 0° and 50° F. A substantial portion of the wax is precipitated from the waxy oil under these conditions of cold solvent injection and high agitation. The DILCHILL process is described in greater detail in U.S. Pat. No. 3,773,650, hereby incorporated by reference.

A modification of the DILCHILL process is presented in U.S. Pat. No. 3,775,288, also hereby incorporated by reference. In the modified DILCHILL process, cooling by means of cold solvent injection and high agitation is conducted to a temperature greater than the temperature at which the wax is separated from the oil, i.e., the wax separation temperature but generally less than about 40° F. above said separation temperature and preferably less than about 35° F. above said separation temperature, thereby precipitating at least a portion of the wax from the waxy oil. This oil-solvent-wax slurry is then withdrawn from the DILCHILL chilling zone and introduced into a second chilling zone wherein it is cooled to the wax separation temperature, thereby precipitating a further portion of the wax from the waxy oil. Cooling rates in this zone are in the range 5°-20° F./min.

This modification is practiced so as to avoid employing the large volumes of cold solvent which would otherwise be necessary to reduce the temperature of the oil-solvent-wax slurry all the way down to the wax separation temperature. In this embodiment, the second chilling zone may incorporate any conventional cooling process such as scraped surface chilling, autorefrigeration and the like; however, scraped surface chilling is preferred. In scraped surface chillers, the partially cooled oil-solvent-wax slurry is indirectly cooled to the wax separation temperature without the addition of more solvent. The scrapers are used to remove any wax which adheres to the walls of the chillers. A disadvantage of the scraped surface chiller in this embodiment is the same as that encountered when employing scraped surface chillers as the sole cooling unit. The scrapers physically crush the wax crystals formed on the chiller wall thereby reducing the wax filtration rates and increasing the amounts of occluded oil in the wax.

U.S. Pat. No. 4,140,620 to Paulett describes an incremental dilution dewaxing process wherein a lubricating oil stock, at a temperature above its cloud point is cooled in a cooling zone with vigorous agitation to a temperature below its cloud point and then further cooled with minimum agitation and incremental solvent addition to its final temperature, followed by filtration for the removal of wax. Rapid stirring is provided during the early part of the cooling period. The cooling zone is described as being a conventional double wall heat exchanger provided with means for agitating the oil during cooling by more rapid rotation of the scrapers. The base oil stock is diluted with solvent, during the initial agitated chilling. The major portion of the solvent is added to the system after the initial wax crystals have formed, i.e., after the temperature of the oil base stock, with or without dilution, has reached a temperature slightly below the cloud point of the waxy petroleum fraction. From the figure in the patent it is seen that the cooling zone comprises a double wall chiller wherein the waxy oil feed is introduced into the inner zone with cold filtrate supplied to the outer jacket of the chiller, with increased agitation being provided by increased rotational speed of the scrapers.

It is clear that the bulk of the solvent is added after the initial high agitation cooling and before or during the low or no agitation final cooling steps.

DESCRIPTION OF THE FIGURE

FIG. 1 is a schematic of an agitated heat exchanger suitable for use in the present process.

DESCRIPTION OF THE PRESENT INVENTION

It has been discovered that wax can be efficiently removed from waxy oil employing high speed agitation indirect cooling, optionally in combination with multipoint solvent injection, either as the sole dewaxing chilling process, or in conjunction with DILCHILL dewaxing in place of scraped surface chilling.

In the process of the instant invention, the waxy oil with or without predilution, preferably without, is heated to insure the complete solution of the wax therein. This waxy oil then enters the zone of high speed agitation and indirect heat exchange where dewaxing solvent is simultaneously added at a plurality of points, if needed, so as to avoid sudden temperature reductions in excess of 40° F. and to achieve the diluting required at the wax separation temperature, and cooled in a single step (using either a single, or plurality of high agitation direct chilling units) to the wax separation temperature at a cooling rate of 1°-20° F./min. The final oil-solvent ratio is in the range of 1:2 to 1:5, depending on feedstock. It is unnecessary that the solvent be cold, since chilling is conducted by the indirect heat exchanger, but cold solvent (e.g. −20° F.,) can be used to reduce refrigeration requirements. The novel feature of this embodiment of the instant invention is the employment of high agitation all the way to the wax separation temperature. The precipitated wax is separated from the wax-oil-solvent slurry in liquid-solid separation means.

Alternatively, the DILCHILL process described in U.S. Pat. No. 3,775,288 can be modified by substitution of the instant high speed agitator indirect heat exchanger for the scraped surface chillers described therein. In this embodiment, the partially cooled, partially dewaxed oil from the DILCHILL tower is directed, either with or without the prior addition of additional solvent, at a temperature above the wax separation temperature, but less than about 50° F. above said separation temperature to the high speed agitator indirect heat exchanger for chilling to the final wax separation temperature. Chilling in the agitated chiller to the wax separa-tion temperature is at a rate of from 1°-20° F./min.

The high speed agitation serves the purpose of insuring uniform crystal growth and of inducing high slurry velocities at the exchanger surfaces. The high agitation prevents deposition of wax on the exchanger chilling surface and gives heat transfer coefficients equivalent to scraped surface chilling. The high agitation in the indirect heat exchangers can be obtained by any number of methods, i.e., high speed rotating turbines, propellers or paddle blades; oscillating or reciprocating shafts with plate collars, "donuts", paddle etc. attached thereto; high frequency sonic vibrations, etc. The preferred method employs either the rotating turbine, propeller or paddle blade or the oscillating shaft with plate or plates attached thereto. No limit is placed on the type, number or configuration of the propellers, turbines, paddles or plates used in the high speed agitators.

A specifically preferred high speed agitator-heat exchanger is presented in FIG. I. The agitator-heat exchanger unit comprises an indirect double wall heat exchanger (1) wherein the chilling fluid (coolant) is introduced via inlet (2) and passed through the passageway (P) defined between the inner (3) and outer (4) walls of the unit to the outlet (5) and the material to be chilled (slurry), introduced into the unit via inlet (6) is passed through the central passageway (CP). Additional solvent is needed to avoid sudden temperature reduction or needed to achieve the dilution required at the wax separation temperature may be added via line B (controlled by valve B).

High agitation is effected by means of a supported, articulated multi-section shaft having multiple blades radially attached to each section. The multisection articulated shaft having multiple blades attached thereto (S) is positioned within the central passageway of the double wall heat exchanger so as to produce a high level of agitation in the material passing therethrough. The multiple blades (7) may be paddles, propeller blades or turbine blades, but are preferably propeller blades sited on the shaft so as to augment agitation and fluid flow in the direction of the slurry passing through the central passageway. The articulated shaft comprises two or more rigid sections (8A-8Z, four sections being shown in the figure it being understood that the articulated shaft may contain any number of sections), one section (PA) being coupled at one end to a drive means (9) to produce the axial rotation of the shaft. The opposite end of said shaft section (8A), supported by a steady bearing (10), is secured by means of an articulation or flexible coupling or universal joint (11) to the second shaft section (8B), each shaft section being in turn secured by similar articulation or flexible couplings or universal joints (11) to the next shaft section (8Y etc.), each shaft section also being supported and maintained within the central passageway of the double wall heat exchanger by a steady bearing (11) positioned within the central passageway. Preferably, the steady bearing is located on the shaft at the end opposite the articulation or flexible coupling or universal bearing. These steady bearings attached to the shaft are preferable machined so as to just slide into the central passageway and remain motionless themselves within the passageway without the need for being welded, bolted or any other way secured to the internal walls of the central passageway. Because of the segmented nature of the agitation unit, an agitator shaft of any desired length can be fabricated and installed into existing double wall heat exchangers. This design of universal joints and steady bearings in combination with the shaft sections bearing propeller blades results in a unit in which vibration and shaft misalignment are not transmitted along the length of the shaft, and allows the shaft to conform to tubes containing sags or slight bends.

Agitation is described as being high, or turbulent, when the dimensions number known as the Impeller Reynolds Number (Perry, *Chemical Engineer's Handbook*, 5th ed., Page 19-6, McGraw-Hill, New York (1973), $N_{Re}$, which is defined by the equation:

$$N_{Re}=(L^2nl/u)$$

wherein L is the impeller diameter, N is the rotational speed, l is the fluid density and u is the fluid viscosity, (units being such that the group is dimensionless), exceeds 10,000. Values of $N_{Re}$ between 10 and 10,000 form a transition zone where flow is turbulent at the impeller and laminar (quiet) in remote parts of the vessel such as at the vessel walls.

As previously stated, the waxy oil is diluted with a wax solvent. This solvent can be selected from any of the known, readily available solvents. Representation examples of such solvents are the aliphatic ketones having from 3 to 6 carbon atoms, such as acetone, methylethyl ketone (MEK) and methyl isobutyl ketone (MIBK); the low molecular weight hydrocarbons such as ethane, propane, and butane and propylene, as well as mixtures of the aforementioned ketones with $C_6$ to $C_{10}$ aromatic compounds such as benzene and toluene. In addition, halogenated low molecular weight hydrocarbons, such as $C_2$ to $C_4$ chlorinated hydrocarbons, e.g., dichloromethane, dichloroethane, etc., and mixtures thereof, may be used as solvents. Specific examples of suitable solvent mixtures are methylethyl ketone and methyl isobutyl ketone, methylethyl ketone and toluene, dichloromethane and dichloroethane, and propylene and acetone.

The preferred solvents are the ketones with methylethyl ketone, methyl isobutyl ketone and mixtures thereof being especially preferred.

The process of the instant invention will be practiced at a pressure sufficient to prevent flashing of the solvent. Atmospheric pressure is sufficient when ketones, ketones/aromatics mixtures or halocarbons are employed; however, when low molecular weight hydrocarbons such as propane are used, superatmospheric pressures are necessary to avoid autorefrigeration effects accompanied by the loss of diluent solvent.

Any waxy hydrocarbon oil, petroleum oil, lube oil or other distillate fraction may be dewaxed by the process of this invention. In general, these waxy oil stocks will have a boiling range within the broad range of about 500° F. to about 1300° F. The preferred oil stocks are the lubricating oil and speciality oil fractions boiling within the range of 550° F. and 1200° F. These fractions may come from any source such as the paraffinic crudes obtained from Aramco, Kuwait, the Panhandle, North Louisana, Western Canada, Tia Juana, etc. The hydrocarbon oil stock may also be obtained from any of the synthetic crude processes now practiced or envisioned for the future such as coal liquefaction, synfuel, tar sands extraction, shale oil recovery, etc.

EXAMPLE 1

A Western Canadian Crude 600N oil was fed to a DILCHILL crystallizer at 134° F., 5° F. above its cloud point. 3.2 volumes of −20° F. solvent (25% methylethylketone, 75% methylisobutylketone) were added incrementally to the DILCHILL crystallizer stages under conditions of high agitation so that the wax-solvent-oil slurry (I) leaving the crystallizer was at 39° F. The slurry (I) was first passed, (stream A) to a conventional scraped surface chiller internal diameter 4 inches, length 5 feet with scrapers rotating at 24 RPM, and then (stream B) passed to a high speed agitation indirect chiller fitted with 2.7 inch diameter propellers rotating at 1000 RPM (internal diameter 4 inches, length 8 feet) (Impeller Reynolds Number=33,000, slurry density 0.85 g/cc, slurry viscosity 2.0 centipoise). Streams S and B were chilled in the scraped surface chiller or high speed agitation indirect chiller respectively to the wax separation temperature of −10° F. slurry samples (II) were taken from each chiller stream and the filtration characteristics measured. The results are presented below.

TABLE I

| | DILCHILL Plus Scraped Surface Chiller | DILCHILL Plus Agitated Chiller |
|---|---|---|
| Feed Filter Rate ($m^3/m^2$ day) | 4.76 | 5.61 |
| Liquids/Solids | 6.68 | 4.76 |
| Dewaxed Oil Yield After Wash (%) | 67.3 | 74.5 |

The high speed agitation indirect chiller produces a final slurry which demonstrates an 18% increase in filter rate and 7% increase in dewaxed oil yield (=10.6% increase in dewaxed oil produced) due to less oil retention in the wax cake caused by the lower liquid/solids value, as compared to the slurry exiting the scraped surface chiller.

EXAMPLE II

To determine the general applicability of the present invention, a number of different waxy oil feeds were employed in a comparison of DILCHILL/Scraped Surface Chiller with DILCHILL/High Speed Agitation Indirect Chiller. The procedure employed is that of Example I. The Impeller Reynolds Number in this example was 50,000. The results are as presented below.

TABLE II

| Feed | Exch. Speed rpm[A] | Filter Rate $m^3/m^2$ day | Liquids Solids w/w | Dewaxed Oil Yield % | 1st Stage Wax Oil Content % |
|---|---|---|---|---|---|
| Western | 24 | 4.76 | 6.68 | 67.3 | |
| Canadian | 1500 | 5.28 | 4.58 | 74.3 | |
| 600N | | | | | |
| Barosa 56 | 24 | 4.63 | 6.32 | 64.0 | 37.0 |
| | 1500 | 4.78 | 4.26 | 72.0 | 18.0 |
| Heavy | 24 | 4.58 | 6.48 | 75.7 | 30.0 |
| Neutral | 1500 | 4.62 | 5.38 | 80.8 | 20.0 |
| Baytown | 24 | 4.09 | 7.15 | 78.0 | 26.0 |

TABLE II-continued

| Feed | Exch. Speed rpm[A] | Filter Rate $m^3/m^2$ day | Liquids Solids w/w | Dewaxed Oil Yield % | 1st Stage Wax Oil Content % |
|---|---|---|---|---|---|
| 600N | 1500 | 4.41 | 4.66 | 81.8 | 11.0 |
| Baytown | 24 | 8.06 | 5.23 | 76.7 | 31.5 |
| 150N | 1500 | 7.72 | 4.23 | 82.0 | 10.6 |

A-24 rpm speed refers to scraped surface chilling, and 1500 rpm refers to agitated chilling.

EXAMPLE III

Heat transfer coefficient comparison data was obtained employing the DILCHILL/Scraped Surface Chiller train and the DILCHILL/High Speed Agitation indirect chiller train wherein the 4 inch diameter by 5 feet long Scraped Surface Chiller was first run as such as then had its internals replaced with high speed agitation internals. The results are presented below.

TABLE III

| | Speed RPM | Temp. in (°F.) | Temp. out (°F.) | Log Temp. Diff. (°F.) | Mean Coefficient (BTU/hr ft² °F.) | Feed Filter Rate ($M^3/M^2$ day) | Liq./Solid | Dewaxed Oil Yield After Washing |
|---|---|---|---|---|---|---|---|---|
| as Scraped | 10 | 40 | +7 | 59 | 10.1 | 5.03 | 6.32 | 66.5 |
| Surface | 14 | 38 | +2 | 56 | 10.9 | 5.10 | 6.86 | 65.9 |
| Chiller | 24 | 39 | 0 | 52 | 13.4 | 4.76 | 6.68 | 67.3 |
| as Agitated | 1500 | 38 | +2 | 56 | 11.0 | 5.13 | 5.16 | 73.5 |
| Chiller | 1150 | 39 | +1 | 58 | 11.6 | 5.02 | 5.62 | 72.3 |

Clearly, a major advantage of high speed agitation indirect chilling over scraped surface indirect chilling is in improved liquid/solid and in dewaxed yield.

EXAMPLE IV

A Western Canadian Crude 600N waxy oil was fed to a bank of commercial scraped surface chillers (total bank length 2700 feet) at 137° F., 5° F. above its cloud point, after having been prediluted with 0.2 volumes of solvent 45%MEK, 55%MIBK. Solvent is premixed with feed above cloud point before entering scraped surface chillers. The slurry was gradually cooled as it passed through each bank of scraped surface exchangers, with additional solvent (45% MEK, 55%MIBK) increments being added at stream temperature at the point of introduction, until the slurry left the final scraped surface chiller at the filtration temperature (14° F.) containing 2.5 volume of solvent. The scraped surface chiller had an internal diameter of 12 inches. The scraper was run at 30 RPM and chilling was conducted at a rate of 1.6°-3.9° F./min.

A second portion of Western Canadian Crude 600N waxy oil was similarly fed at 136° F. to a bank of high speed agitation indirect chillers (run in train) 2.5 volumes of solvent (45%MEK, 55%MIBK) at 60° F. was added to the waxy oil feed in the first chiller unit. This mixture was passed through a total of three agitated chillers each containing propellers. Two rotational speeds were tested, 1000 and 1500 RPM.

The high speed agitated chiller was 4 inches in internal diameter and 8 feet in length and employed a propeller of 2.7 inches diameter. At 1000 RPM the Impeller Reynolds Number was 33,000 and at 1500 RPM the Impeller Reynolds Number was 50,000. The agitator employed in this example was of the articulated design previously described and presented in FIG. 1.

Throughput in the pilot agitated chiller was chosen so as to give the same chilling rate and residence time as the scraped surface chillers employed in the commercial unit. The agitated chilling rate was 2.8° to 3.8° F./min. (residence time of 40 min.) while for the scraped surface chillers the chilling rate was 1.6° to 3.9° F./min. (residence time of 41.7 min.). As is clear, the superficial velocity of the fluid through the agitated chiller (24 feet total) was much less than the velocity through the scraped surface chiller (2700 feet total) in order to achieve approximately equal residence times.

The slurry exited these trains at wax filtration temperature (14° F.). The data from this comparison is presented below.

TABLE IV

| | Incremental Dilution Dewaxing Using Scraped Surface Chillers | Incremental Dilution Dewaxing Using Agitated Chillers | |
|---|---|---|---|
| | | 1000 rpm | 1500 rpm |
| Feed Filter Rate ($m^3/m^2$ day) | 4.87 | 6.23 | 5.67 |
| Liquids/Solids | 6.55 | 5.95 | 5.00 |
| Dewaxed Oil Yield After Wash | 76.7 | 80.6 | 83.0 |

The increase in filter rate is 28% at 1000 rpm, and 16% at 1500 rpm, using the agitated chiller. Of equal importance is the reduction in liquids/solids which amounts to 9% at 1000 rpm, and 24% at 1500 rpm. This result permits more effective wash application, and a consequent increase in dewaxed oil yield of 3.9% at 1000 rpm, and 6.3% at 1500 rpm.

EXAMPLE V

A Western Canadian Crude 600N oil was fed to a Pilot Plant DILCHILL crystallizer at 137° F., 5° F. above its cloud point. 2.6 volumes of −20° F. solvent (45% methylethylketone, 55% methylisobutyl ketone) were added incrementally to the DILCHILL crystallizer stages under conditions of high agitation so that the wax-solvent-oil slurry leaving the crystallizer was at 39° F. The slurry was then dash pot chilled to the filtration temperature of 20° F., and filtration performance measured. The same oil feed was then fed at 137° F. to a bank of high speed agitation indirect chillers (run in train). 2.7 volumes of solvent (45%MEK, 55%MIBK) at 80° F. was added to the waxy oil feed in the first chiller unit, and the slurry chilled to the wax separation temperature of 20° F., at a cooling rate of 5°-8° F./min. The results are presented in Table V.

TABLE V

| | Filter Rate | Liquid/Solid | DWO Yield after Wash |
|---|---|---|---|
| Pilot Plant DILCHILL & | 6.29 | 5.11 | 78.3 |

TABLE V-continued

| | Filter Rate | Liquid/ Solid | DWO Yield after Wash |
|---|---|---|---|
| Dashpot Agitated Chilling (1000 RPM) | 7.14 | 5.86 | 77.2 |

The DILCHILL result is with no effect of SS chilling or agitated chilling. The slurry is sampled at the DILCHILL tower outlet, and dash pot chilled in the lab to the filtration temperature. It contains no debit due to SS chilling. The agitated chilling result shows we can match DILCHILL performance and eliminate SS chilling debit all the way to the filter temperature.

What is claimed is:

1. A high agitation heat exchanger apparatus comprising a double wall heat exchanger wherein chilling fluid flows through the passage way defined by the inner and outer walls of the heat exchanger and the material to be chilled flows through the central passageway defined by the inner walls of the exchanger, and an agitation means mounted in the central passageway of the exchanger wherein the agitation means comprises a supported, articulated multi-section shaft having multiple blades radially attached thereto, one end of said multi-section shaft being coupled to a drive means, wherein the section of the multi-section shaft are connected one to the other by articulation means and the support is provided by steady bearings attached to the sections of the multi-section shaft, the steady bearings being sized so as to just slide into the central passageway of the heat exchanger and remain motionless therein without being secured to the internal walls of the heat exchanger.

2. The apparatus of claim 1 wherein the steady bearings located on the sections of the multi-section shaft are positioned on the shaft at the end opposite the articulation means.

3. The apparatus of claim 1 wherein the articulation means is a universal joint.

4. The apparatus of claim 1 wherein the multiple blades are propeller blades.

5. The apparatus of claim 1 wherein solvent is added to the material to be chilled in the central passageway.

6. An apparatus for producing a high level of agitation in a narrow vessel wherein the agitation apparatus comprises a supported, articulated multi-section shaft having multiple blades radially attached thereto, wherein the sections of the multi-section shaft are connected one to the other by articulation means and support for the sections of the multi-section shaft is provided by steady bearings attached to the sections of the multi-section shaft and are such so as to just fit in the central passageway of said vessel and remain motionless therein without being secured to the interior walls of said vessel.

* * * * *